US006164126A

United States Patent [19]

Ciglenec et al.

[11] Patent Number: 6,164,126

[45] Date of Patent: Dec. 26, 2000

[54] EARTH FORMATION PRESSURE MEASUREMENT WITH PENETRATING PROBE

[75] Inventors: Reinhart Ciglenec, Houston; Andrew Kurkjian, Sugar Land, both of Tex.

[73] Assignee: Schlumberger Technology Corporation, Sugar Land, Tex.

[21] Appl. No.: 09/173,107

[22] Filed: Oct. 15, 1998

[51] Int. Cl.[7] ..... E21B 47/10; E21B 49/10

[52] U.S. Cl. ..... 73/152.01; 73/152.02; 73/152.17; 73/152.24; 166/100; 166/254.2; 175/50; 175/59

[58] Field of Search ..... 73/152.01, 152.05, 73/152.02, 152.17, 152.26, 152.24; 166/100, 250.02, 250.17, 254.2; 175/48, 50, 59

[56] References Cited

U.S. PATENT DOCUMENTS

| | | | |
|---|---|---|---|
| 2,398,562 | 4/1946 | Russell | 73/152 |
| 2,725,283 | 11/1955 | Mounce et al. | 23/253 |
| 2,747,401 | 5/1956 | Doll | 73/151 |
| 3,419,089 | 12/1968 | Venghiattis | 175/4.57 |
| 3,448,373 | 6/1969 | Hann | 324/1 |
| 3,528,000 | 9/1970 | Schwede | 324/0.5 |
| 3,577,781 | 5/1971 | Lebourg et al. | 73/152 |
| 3,795,141 | 3/1974 | Planche | 73/151 |
| 3,798,966 | 3/1974 | Planche | 73/151 |
| 3,934,468 | 1/1976 | Brieger | 73/155 |
| 4,334,271 | 6/1982 | Clavier | 364/422 |
| 4,622,849 | 11/1986 | Fertl | 73/152 |
| 4,860,581 | 8/1989 | Zimmerman et al. | 73/155 |
| 4,893,505 | 1/1990 | Marsden et al. | 73/155 |
| 4,929,915 | 5/1990 | Wittrisch | 324/347 |
| 5,198,770 | 3/1993 | Decorps et al. | 324/367 |
| 5,212,354 | 5/1993 | Miller et al. | 181/108 |
| 5,230,244 | 7/1993 | Gilbert | 73/155 |
| 5,233,866 | 8/1993 | Desbrandes | 73/155 |
| 5,302,781 | 4/1994 | Hanson, III | 181/102 |
| 5,323,648 | 6/1994 | Peltier et al. | 73/151 |
| 5,335,542 | 8/1994 | Ramakrishnan et al. | 73/152 |
| 5,438,169 | 8/1995 | Kennedy et al. | 181/102 |
| 5,473,939 | 12/1995 | Leder et al. | 73/155 |
| 5,551,287 | 9/1996 | Maute et al. | 73/152.02 |
| 5,741,962 | 4/1998 | Birchak et al. | 73/152.16 |
| 5,765,637 | 6/1998 | Dietle et al. | 166/55 |
| 5,789,669 | 8/1998 | Flaum | 73/152.51 |
| 5,803,186 | 9/1998 | Berger et al. | 175/50 |
| 5,810,080 | 9/1998 | Meynier | 166/66 |
| 6,026,915 | 2/2000 | Smith et al. | 175/50 |

OTHER PUBLICATIONS

Bishop, R. F., et al., "The Theory of Indentation and Hardness Tests", *The Proceedings of the Physical Society*, The Physical Society, London S.W.7, vol. 57, Part 3, May 1945, No. 321, pp. 147–159.

U. S. Department of Energy Technology Summary Report, "Cone Penetrometer", #DOE/EM–0309, Apr. 1996.

"Piezocone Penetrometer", Fugro IN–SITU Testing Services Commercial Brochure paper regarding calibrating gauge, (date unknown).

Soon Sam Kim, "Penetrator and Dart NMR Probes," May 1997, NASA Tech Briefs, pp. 56, 58.

*Primary Examiner*—Daniel S. Larkin
*Assistant Examiner*—David J. Wiggins
*Attorney, Agent, or Firm*—Steven L. Christian

[57] ABSTRACT

The present invention relates to an apparatus and method for measuring a property of a subsurface formation intersected by a wellbore, which contemplate the use of a tool body adapted for movement through the wellbore. Actuating means is carried by the tool body, and a probe is propelled by the actuating means for movement of the probe between a retracted position within the wellbore and an extended position penetrating a wall of the wellbore such that the probe engages the formation. The probe is adapted for substantially producing a seal at the wall of the wellbore as the probe is moved to the extended position, and the probe has means therein for measuring the property of the formation engaged by the probe.

54 Claims, 14 Drawing Sheets

EARTH FORMATION PRESSURE MEASUREMENT WITH PENETRATING PROBE

BACKGROUND OF THE INVENTION

1. Field of the Invention

This invention relates generally to the drilling of deep wells such as for the production of petroleum products, and more specifically concerns the acquisition of subsurface formation pressure data while well drilling operations are in progress.

2. Description of the Related Art

Present day oil well drilling relies heavily on continuous monitoring of various well parameters. One of the most critical inputs needed to ensure safe drilling is formation pressure. Presently, no formation pressure measurement is performed while drilling; only annulus pressure is measured. Various types of wireline tools, known as "formation testers," are currently in use which connect pressure sensors to subsurface formations intersected by a wellbore. The operation of such formation testers requires a "trip," in other words, removing the drill string from the wellbore, running the formation tester into the wellbore to acquire the formation data and, after retrieving the formation tester, possibly running the drill string back into the wellbore for further drilling. Because "tripping the well" in this manner uses significant amounts of rig time, which is very expensive, wireline formation testers are typically operated only under circumstances where the formation data is absolutely necessary or when tripping of the drill string is already being done for a drill bit change or for other reasons, such as having reached the desired depth.

During well drilling activities, the availability of reservoir formation pressure data on a "real time" basis is also a valuable asset for safely drilling a well. Drilling mud weight, used to control the wellbore pressure, is typically adjusted upon bit depth and drilling rates only. Real time formation pressure obtained while drilling will allow a drilling engineer or driller to make decisions concerning changes in drilling mud weight and composition as well as penetration parameters at a much earlier time to promote safer conditions while drilling.

The availability of real time reservoir formation data is also desirable to enable precise control of the weight on the drill bit in relation to formation pressure changes and changes in permeability so that the drilling operation can be carried out at its maximum efficiency.

It is desirable therefore to provide a method and apparatus for well drilling that enable the acquisition of formation data such as pressure data from a subsurface zone of interest while the drill string with its drill collars, drill bit and other drilling components is present within the wellbore, thus eliminating or minimizing the need for tripping the well drilling equipment for the sole purpose of running formation testers into the wellbore for measurement of a formation parameter.

It is therefore an object of the present invention to provide a novel method and apparatus for acquiring subsurface formation data while drilling of a wellbore is in progress, without necessitating tripping of the drill string from the wellbore.

It is a further object of the invention to acquire subsurface formation data in a time efficient manner so as to reduce the likelihood of the drill string becoming stuck in the wellbore and to reduce or eliminate disruption of drill string operations.

It is a further object of the present invention to provide such a novel method and apparatus by means of a probe that is moveable from a wellbore tool, such as a drill collar or a wireline sonde, to an extended position in engagement with the formation.

It is a still further object of the invention to provide such a probe that is adapted for substantially forming a seal at the wall of the wellbore as the probe is moved into engagement with the formation.

Known wireline conveyed formation testers have a toroid shaped rubber packer through which a probe nozzle is pressed against the borehole wall. After a local seal around the packer area is achieved, hydraulic communication through the probe is established and formation pressure is measured. Unless they are well protected, such rubber packers disintegrate rapidly under standard drilling conditions.

Also, the integrity of a packer seal relies on the existence of drilling mud and "mudcake" lining the wellbore wall. During drilling processes, the mud is circulated through the annulus between the wellbore wall and the drill string, reducing the amount of mudcake available for forming an effective seal at the wellbore wall.

It is therefore a further object of the invention to provide a method and apparatus for measuring formation parameters such as pressure that dispenses with the need for elastomeric packers or the like for achieving a hydraulic seal about a pressure communicating probe, and that forms such a seal at the wellbore wall during drilling operations when the extent of mudcake lining the wellbore wall is reduced.

SUMMARY OF THE INVENTION

The objects described above, as well as various objects and advantages, are achieved by an apparatus for measuring a property of a subsurface formation intersected by a wellbore. The apparatus contemplates the use of a tool body adapted for movement through the wellbore. Actuating means is carried by the tool body, and a probe is propelled by the actuating means for movement of the probe between a retracted position within the wellbore and an extended position penetrating a wall of the wellbore such that the probe engages the formation. The probe is adapted for substantially producing a seal at the wall of the wellbore as the probe is moved to the extended position, and the probe has means for measuring the property of the formation engaged by the probe.

In one embodiment of the present invention, the measuring means includes a passageway that extends from a port adjacent a nose portion of the probe to a measuring junction within the probe so as to transmit fluid from the formation to the measuring junction. A sensor communicates with the passageway of the probe via the measuring junction to measure the property of the formation.

The sensor may be a pressure sensor, for example, which communicates with the passageway of the probe via the measuring junction to measure the pressure of the formation. In this case, the measuring means can include a hydraulic interface such as a membrane for transmitting formation fluid pressure, rather than formation fluid, to the pressure sensor.

The sensor may be disposed within the probe, or elsewhere such as within the actuating means or the tool body. Also, the sensor can be positioned at various locations within the probe, actuating means, or tool body.

The present invention is adaptable for use while drilling as well as during wireline operations, so the tool body may be a drill collar positioned within a drill string or a wireline sonde suspended in the wellbore on a wireline.

The actuating means preferably comprises a hydraulic piston actuated by hydraulic fluid to move the probe between the retracted and extended positions. In one embodiment, the probe and the hydraulic piston constitute a monolithic structure.

It is also preferred that the probe have a nose portion that is shaped for reducing the force required from the actuating means for moving the probe to the extended position. In this regard, the nose portion is preferably conical, and more particularly, has a cone inclination angle no greater than 45°.

In one embodiment, the probe includes a tail portion in addition to a nose portion, and is equipped with a tapered portion between the nose portion and the tail portion for substantially producing the seal at the wellbore wall as the probe is moved from the retracted position to the extended position.

In another embodiment, the probe of the present invention preferably includes a leading portion, a trailing portion, a tapered portion intermediate the leading portion and the trailing portion for substantially forming a seal at the wall of the wellbore as the probe is moved to the extended position, and a passageway extending through the tapered portion for measuring the property of the formation. The passageway extends from a port ahead of the tapered portion of the probe to a measuring junction behind the tapered portion of the probe so as to transmit fluid from the formation to the measuring junction when the probe is moved to the extended position.

In another embodiment, the probe of the present invention includes a first member having a first bore therein and a tapered outer surface. The first member is propelled by the actuating means for movement of the first member between a retracted first member position within the wellbore and an extended first member position whereat the tapered outer surface at least partially penetrates the wall of the wellbore. The probe of this embodiment further includes a second member disposed in the first bore and having a second bore therein and a conical nose portion. A port in the second member communicates with the second bore. The second member is propelled by the actuating means for movement of the second member through the first bore between a retracted second member position within the wellbore and an extended second member position whereat the conical nose portion penetrates the formation and the port is positioned beyond the first member. The probe of this embodiment further includes a third member disposed in the second bore and having at least a portion of the passageway therein. The third member is propelled by the actuating means for movement of the third member through the second bore between a position closing the passageway and a position opening the passageway to permit formation fluid to reach the passageway via the port for measuring the property of the formation.

In another aspect, the present invention contemplates a method that includes the step of moving a tool body through the wellbore to the depth of a desired formation intersected by the wellbore. The tool body is equipped with a probe including a tapered portion and a fluid communicating means. Another step requires moving the probe from a retracted position within the wellbore to an extended position penetrating a wall of the wellbore in engagement with the formation such that the tapered portion of the probe substantially forms a seal at the wall of the wellbore. The method further includes the step of communicating fluid from the formation through the fluid communicating means in the probe to a sensor to measure the formation property.

BRIEF DESCRIPTION OF THE DRAWINGS

So that the manner in which the above recited features, advantages and objects of the present invention are attained can be understood in detail, a more particular description of the invention, briefly summarized above, may be had by reference to the preferred embodiments thereof which are illustrated in the appended drawings.

It is to be noted however, that the appended drawings illustrate only typical embodiments of this invention and are therefore not to be considered limiting of its scope, for the invention may admit to other equally effective embodiments.

In the drawings:

FIG. 1 is a diagram of a portion of a drill string positioned in a borehole and equipped with a drill collar and actuating means capable of moving a probe into engagement with a subsurface formation in accordance with the present invention;

FIG. 2 is a schematic illustration of a portion of the drill collar having a hydraulically energized actuating means for forcibly moving the probe between a retracted position in the drill collar and an extended position engaging a selected subsurface formation;

FIGS. 3A–3D are sequential illustrations, in cross-section, of one embodiment of the probe in the retracted position, in an intermediate position, in the extended position, and measuring a formation property such as pressure through a passageway in the probe while at the extended position, respectively;

Figure 4A:
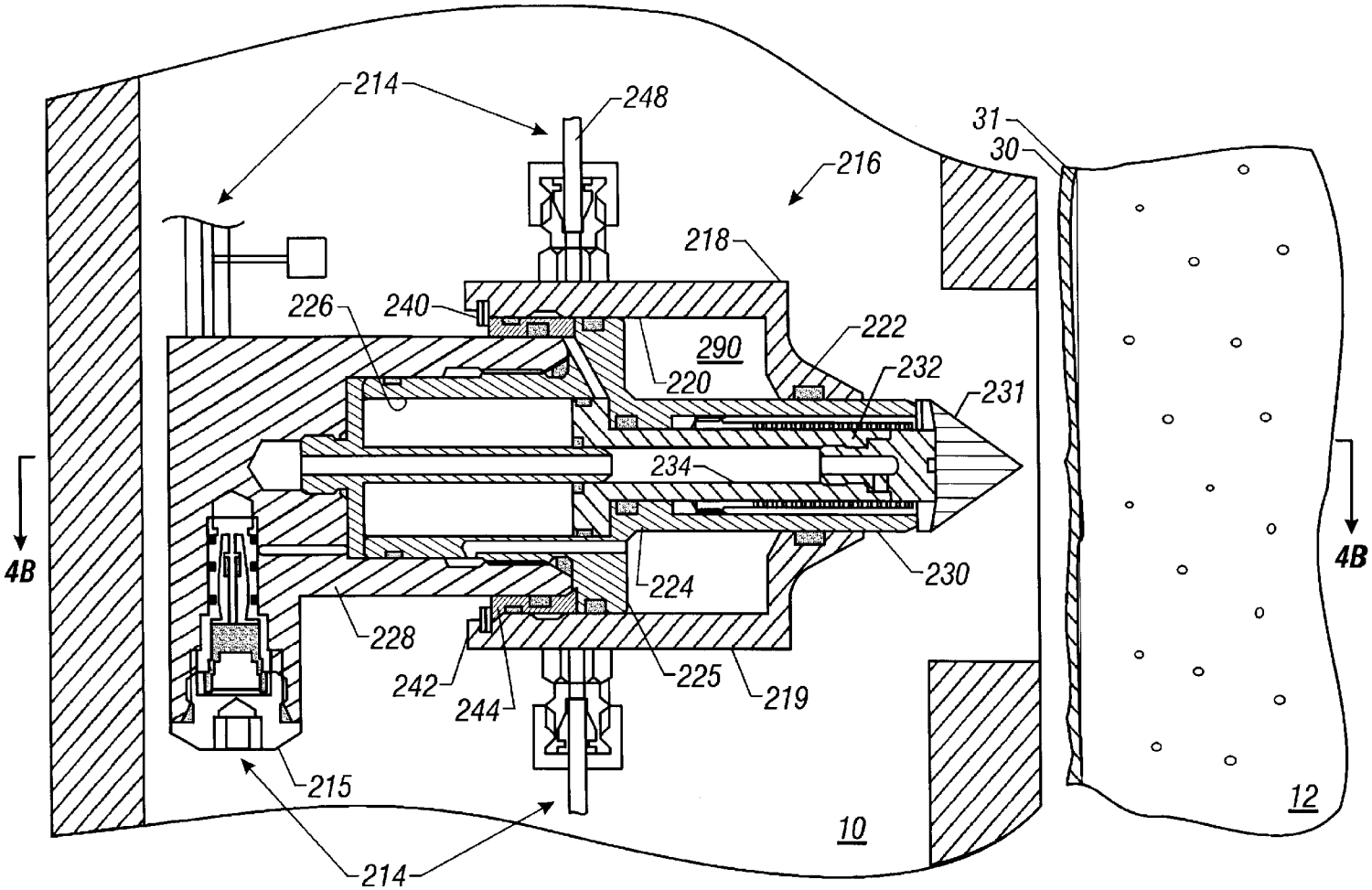
Figure 4B:
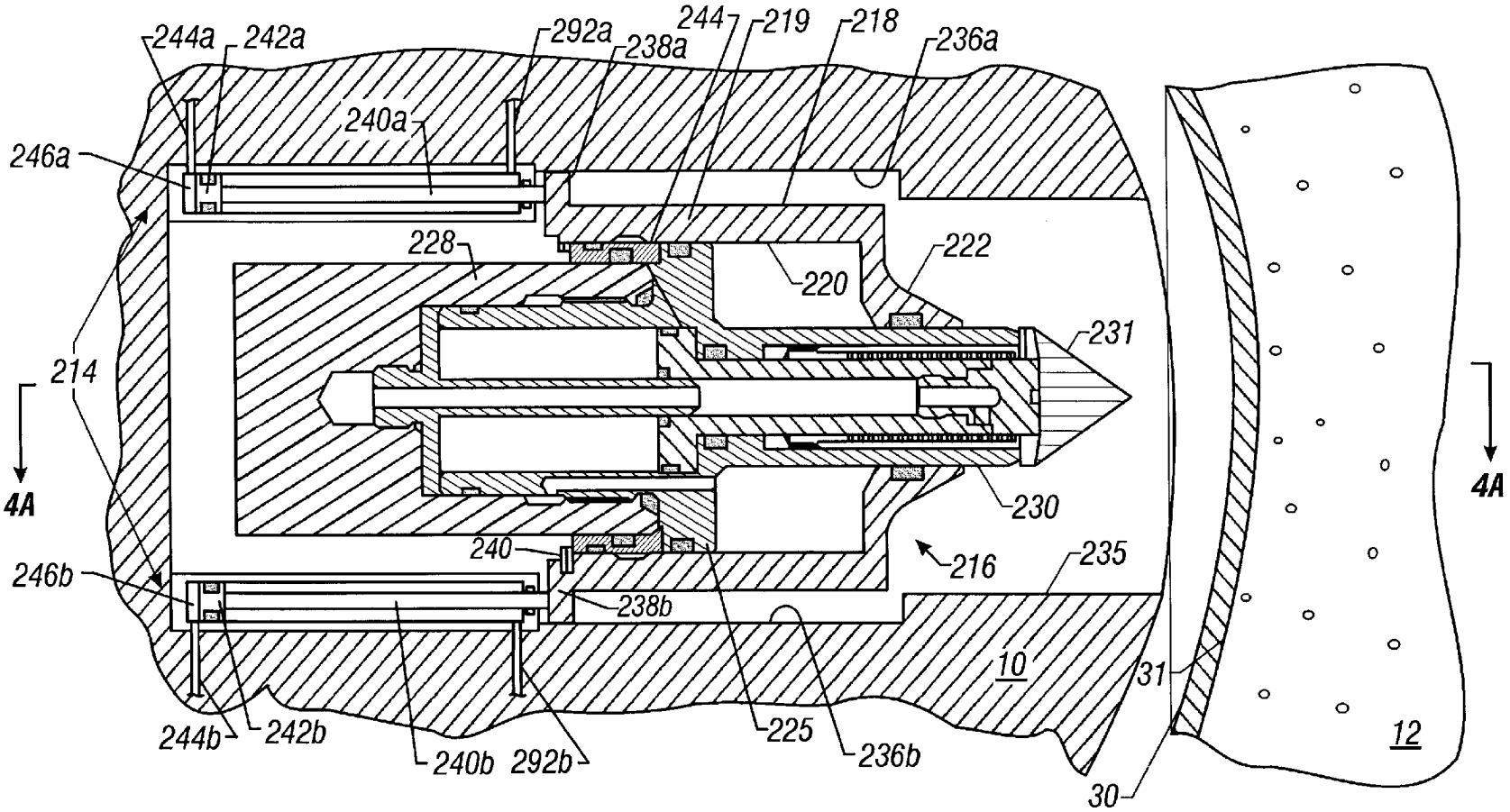
Figure 4C:
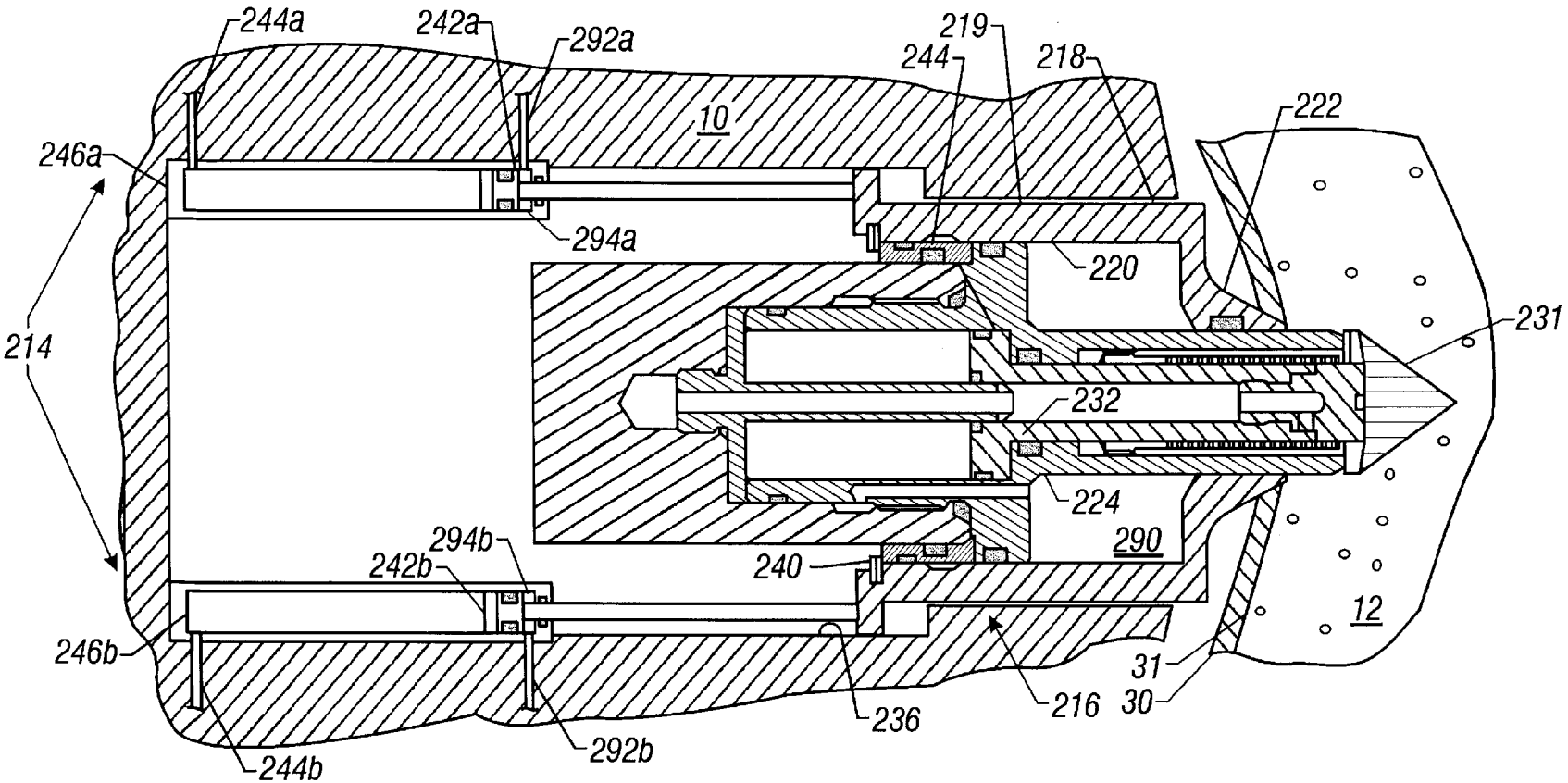
Figure 4D:
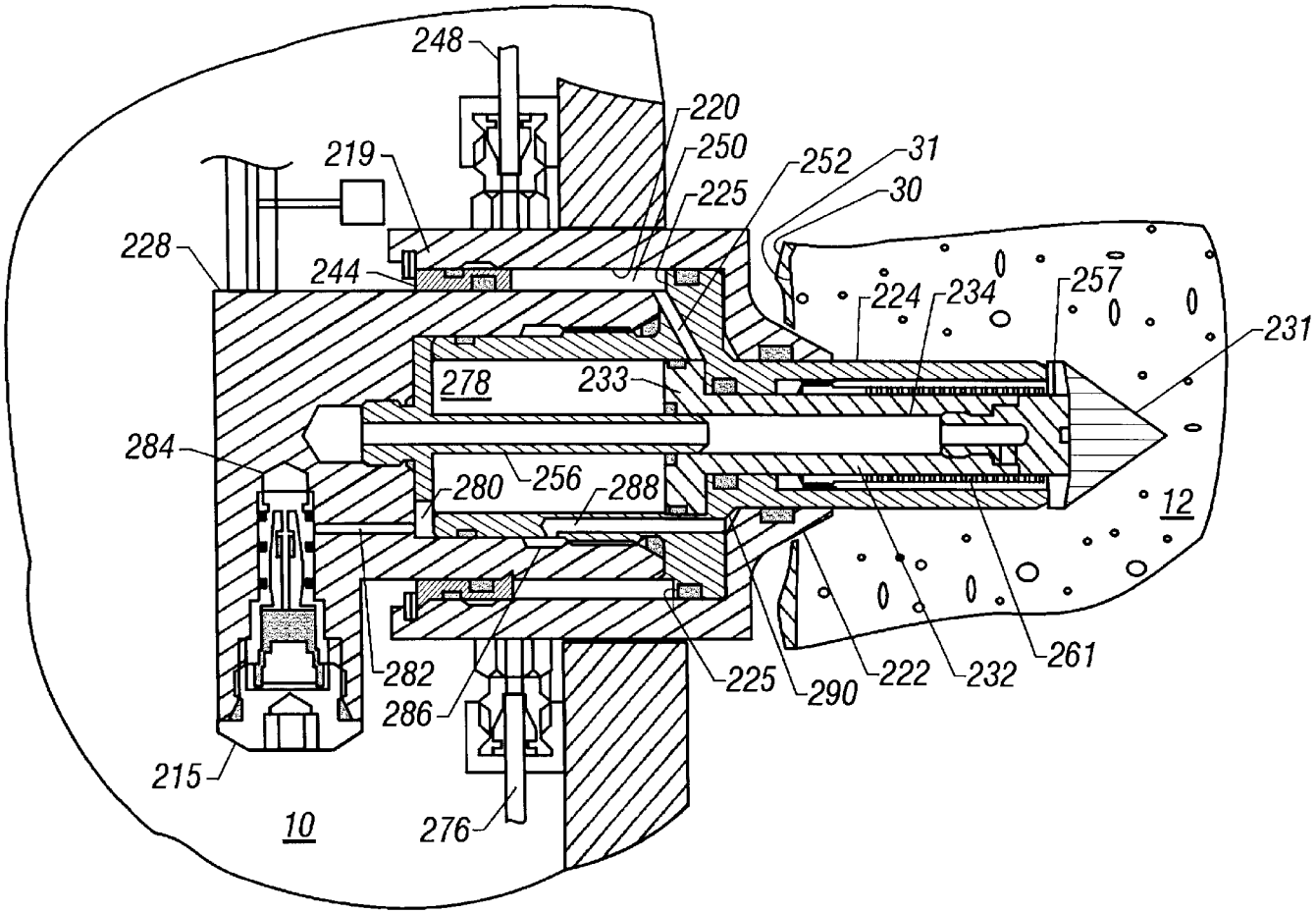
Figure 4E:
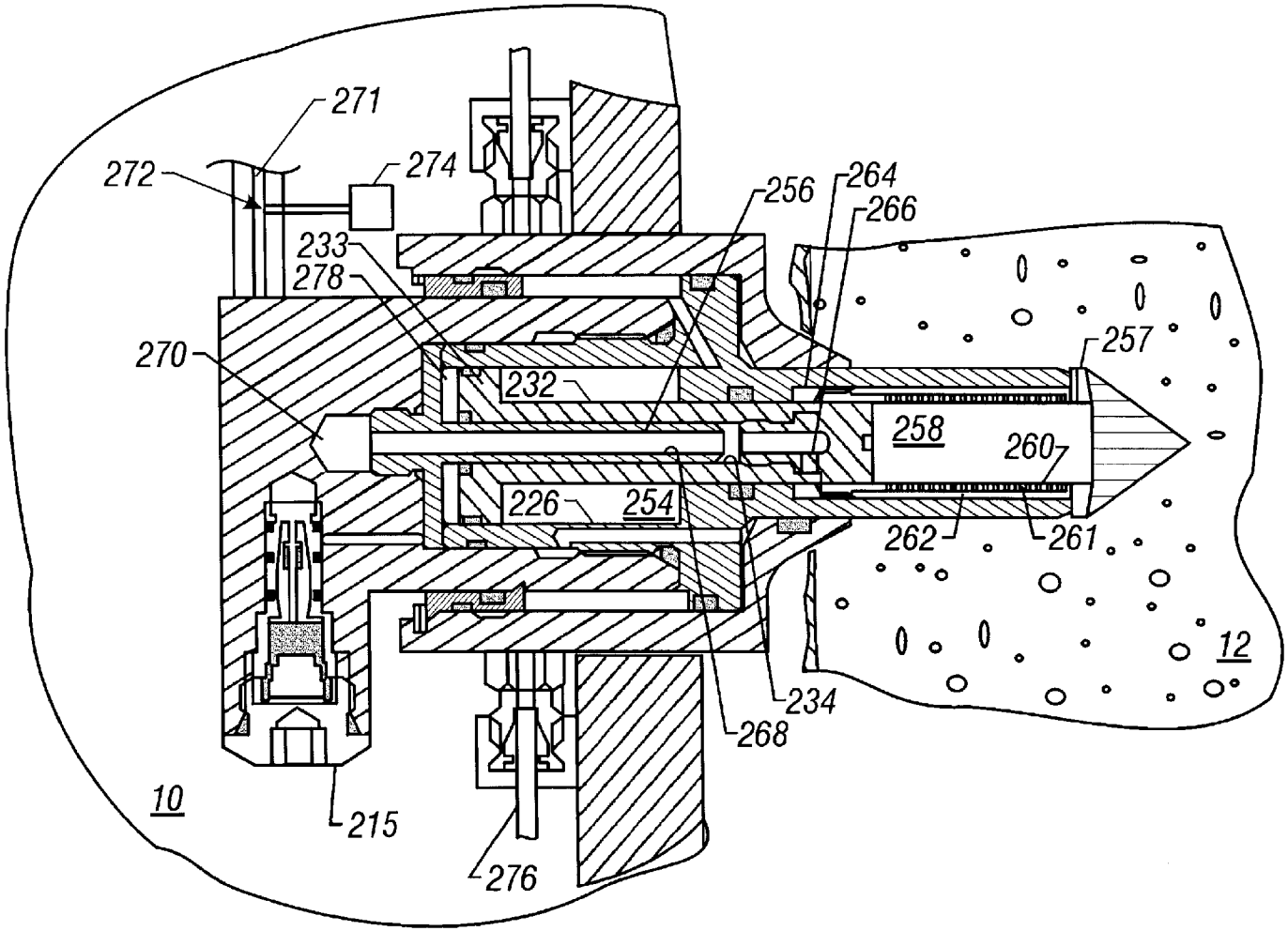

FIGS. 4A, 4D, and 4E are sequential illustrations, in cross-section, of a second embodiment of the probe in the retracted position, in the extended position, and measuring a formation property through the passageway in the probe while at the extended position, respectively;

FIG. 4B is a sectional view taken along section line 4B—4B in FIG. 4A; FIG. 4C is a sectional view similar to FIG. 4B with the second probe embodiment positioned in an intermediate position.

Figure 5A:
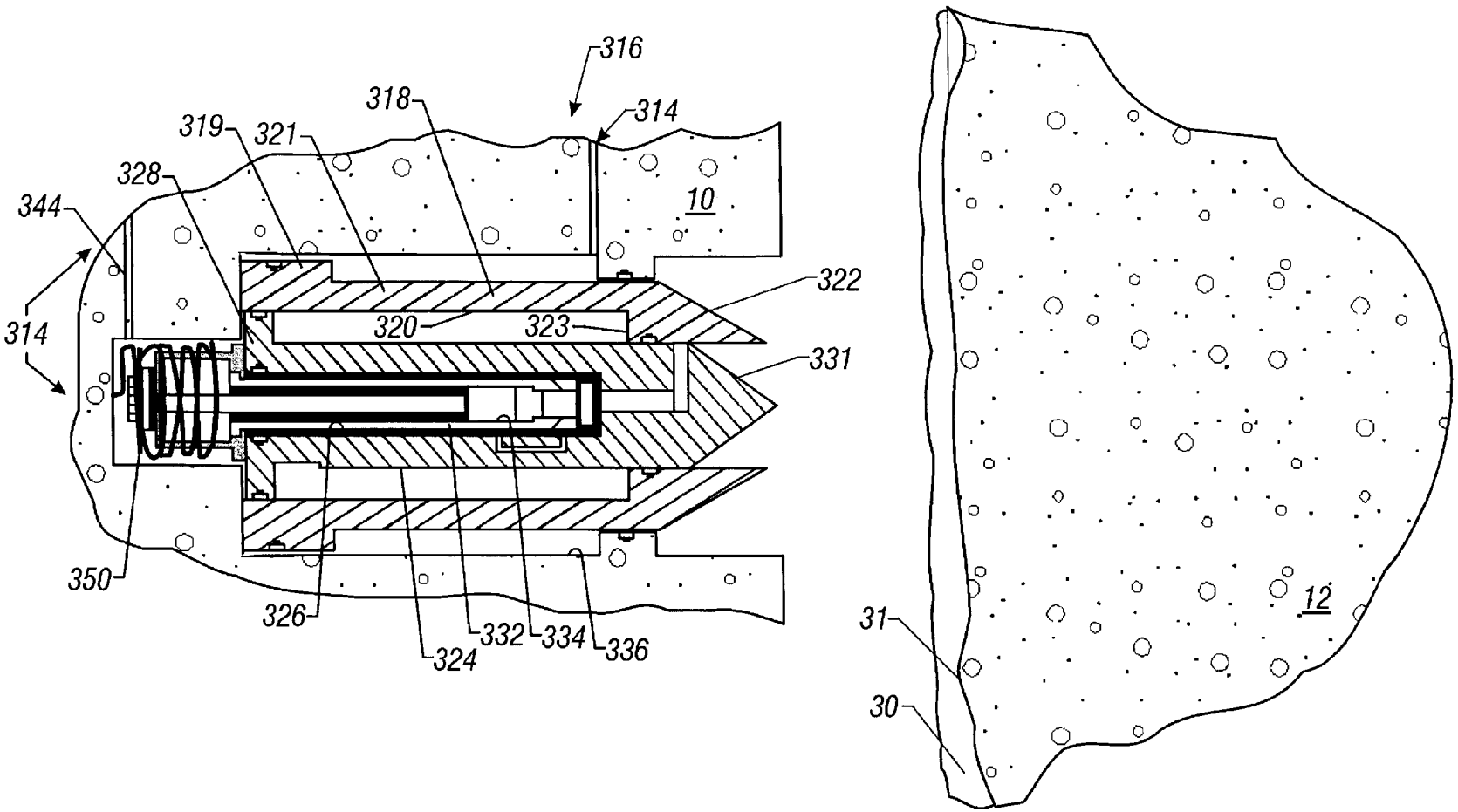
Figure 5B:
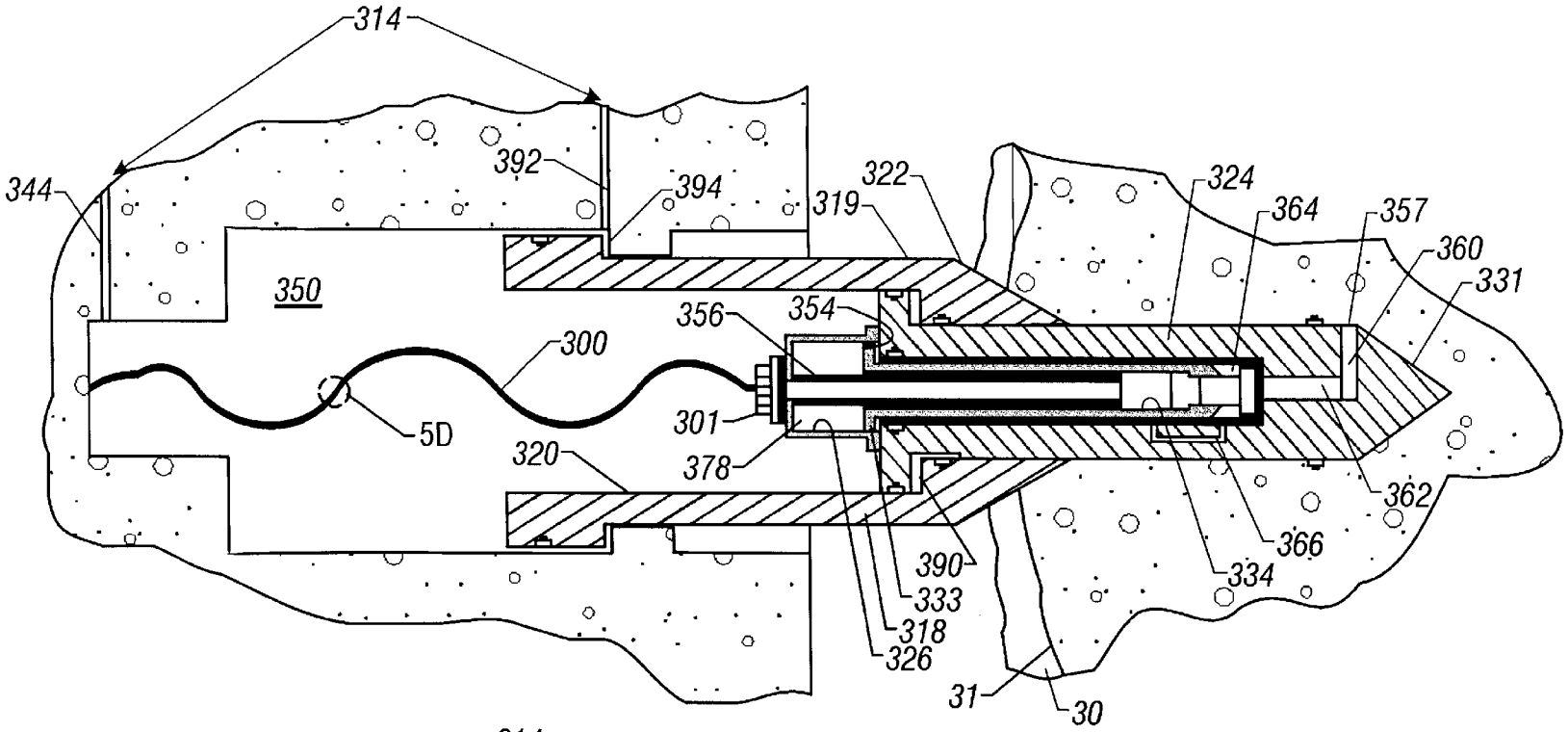
Figure 5D:
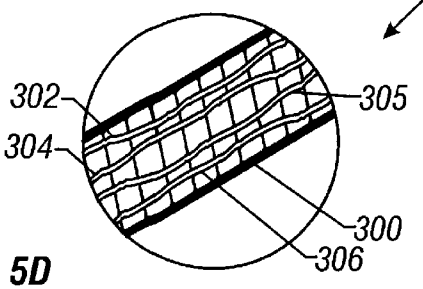
Figure 5C:
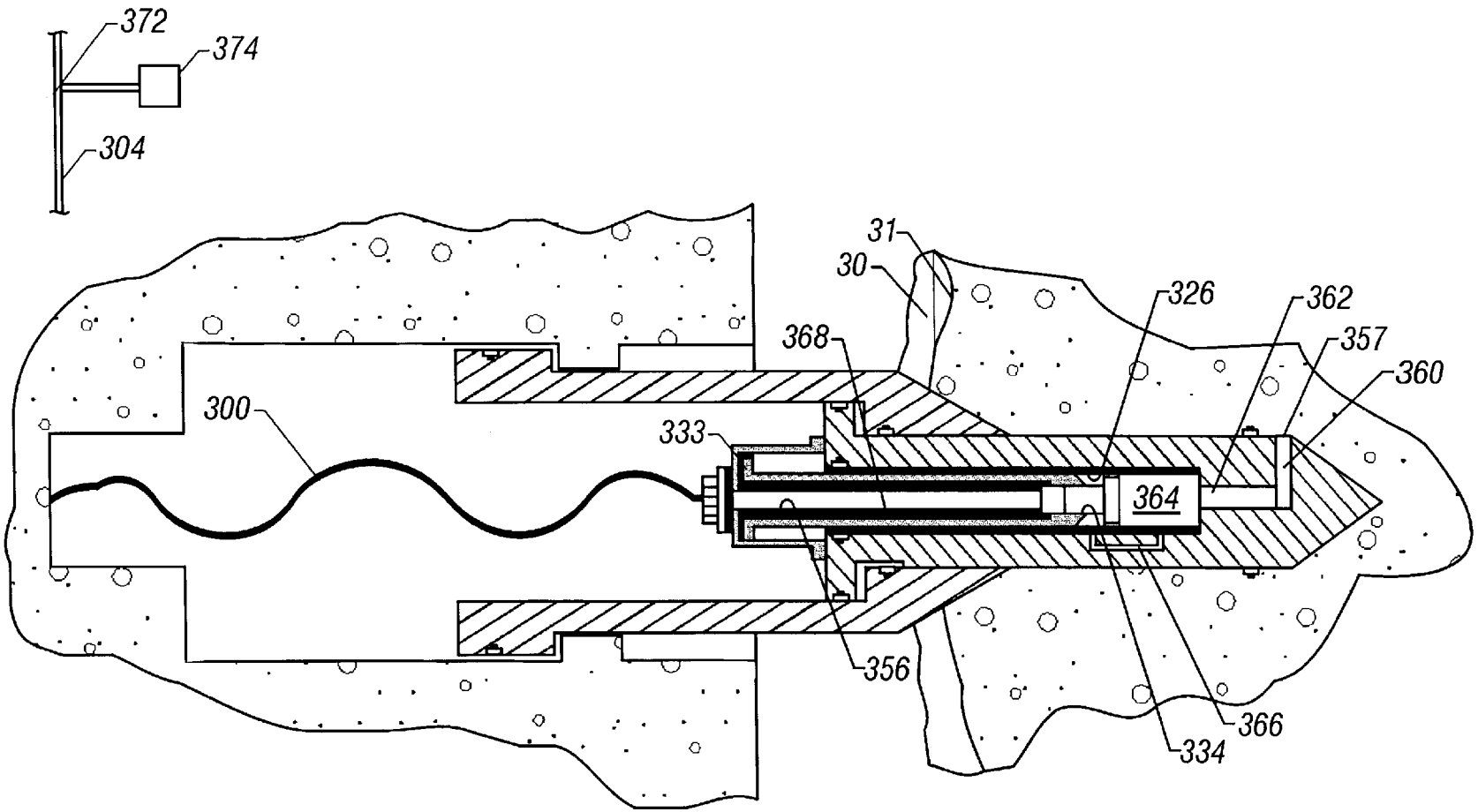
Figure 6:
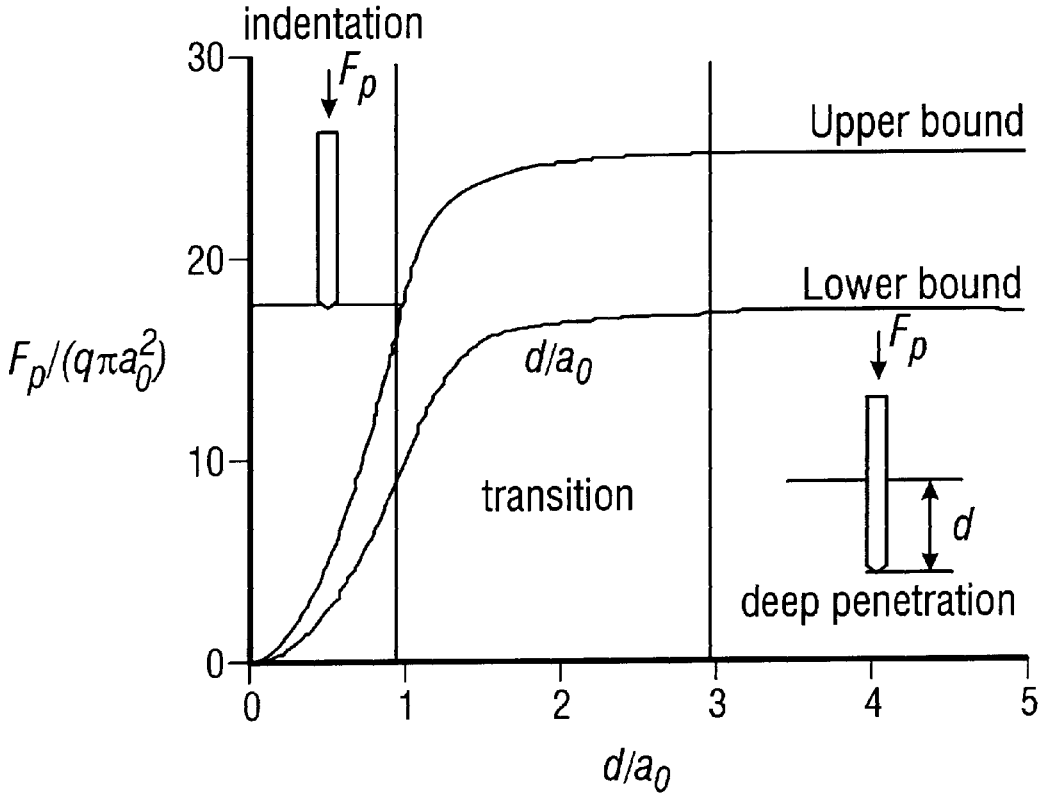

FIGS. 5A–5C are sequential illustrations, in cross-section, of a third embodiment of the probe in the retracted position, in the extended position, and measuring a formation property through the passageway in the probe while at the extended position, respectively; and FIG. 6 is a plot illustrating the relationship between probe penetration depth d and penetration force $F_p$, for a given probe radius $a_0$.

DETAILED DESCRIPTION OF THE INVENTION

Figure 1:
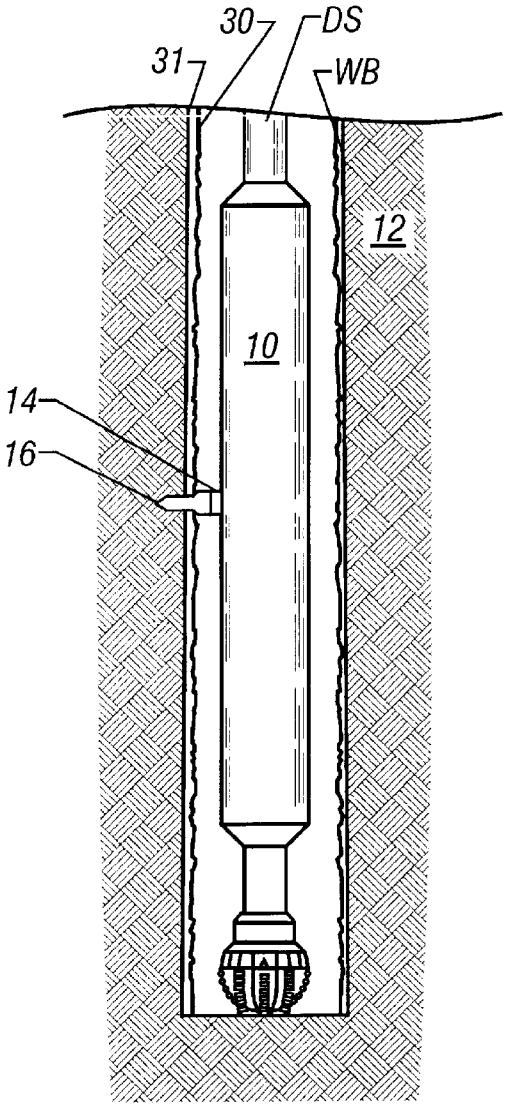

As shown in FIG. 1, the present invention relates to an apparatus for measuring a property, such as pressure, of subsurface formation 12 intersected by wellbore WB. In a preferred embodiment, the apparatus utilizes a tool body adapted for movement through wellbore WB in the form of drill collar 10 connected within drill string DS which is disposed in the wellbore. However, the apparatus is also well suited for use within other tool bodies, such as a wireline sonde suspended from a wireline.

Drill collar 10 includes actuating means, generally referred to as 14, that propel probe 16 for movement of the probe between a retracted position within the wellbore and an extended position penetrating a wall of the wellbore such that the probe engages the formation. The extended probe position is illustrated in FIGS. 1, 3C, 3D, 4D, 4E, 5B, and 5C for various embodiments of the invention, as will be described further below. Movement of probe 16 can be achieved by utilizing one or a combination of the following actuating means: a hydraulic piston assembly, a mechanical lever assembly, a spindle drive, or similar deployment methods.

Figure 2:
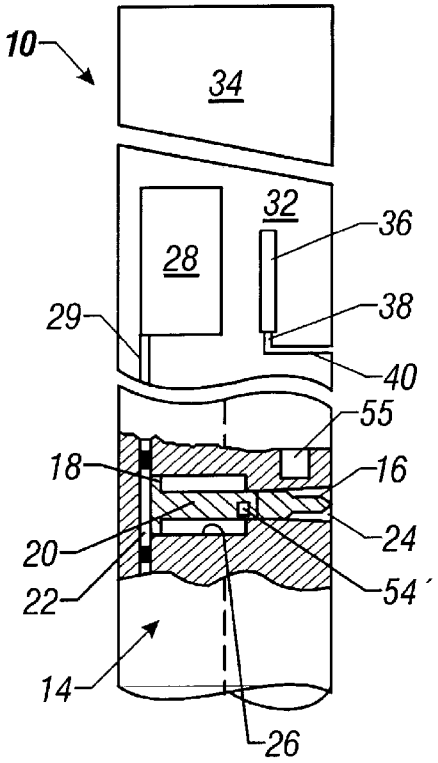

FIG. 2 illustrates one embodiment of probe 16 and actuating means 14 within drill collar 10, wherein hydraulically energized ram 20 is employed to propel probe 16 between the retracted position, which is shown in FIG. 2, and the extended position shown in FIG. 1 for measuring the pressure of formation 12. Ram 20 must apply sufficient propulsion force to probe 16 to cause the probe to penetrate the subsurface formation to a sufficient depth outwardly from wellbore WB such that it senses formation pressure without substantial influence from the wellbore fluids. The probe is designed to penetrate several inches, but preferably between one and three inches, through the mudcake 30 lining wellbore wall 31 into downhole formation 12, as shown more particularly in FIG. 3D. For the invention to accomplish its intended purpose, however, the probe need only penetrate the mudcake enough to place a sensing port, such as probe opening 48 described below, on the formation side of the mudcake.

Referring again to FIG. 2, for such penetrating action to occur, drill collar 10 is provided with internal cylindrical bore 26 within which is positioned a piston element 18 having ram 20 that is connected in driving relation with the encapsulated probe 16. Piston 18 is exposed to hydraulic pressure that is communicated to piston chamber 22 from a hydraulic system 28 via a hydraulic fluid supply passage 29. The hydraulic system is selectively activated by power cartridge 34, which is also carried by drill collar 10.

The drill collar is further provided with pressure sensor 36 exposed to the wellbore pressure via drill collar passages 38 and 40. Pressure sensor 36 senses ambient wellbore pressure at the depth of the selected subsurface formation and is used to measure the pressure of the drilling mud in the annulus between the drill string and the wellbore. Electronic signals representing ambient wellbore pressure are transmitted from pressure sensor 36 to circuitry within power cartridge 34 which, in turn, either stores the annulus mud pressure data or transmits it to the surface in a known manner, such as through mud-pulse telemetry.

FIGS. 3A–3D illustrate the one embodiment of probe 16 in greater detail, along with a different embodiment of actuating means 14 than that shown in FIG. 2. The probe is equipped with a leading or nose portion 42, a trailing or tail portion 44, and a tapered portion 46 intermediate the leading portion and the trailing portion. The leading portion is shaped for reducing the force required from actuating means 14 for pressing the probe into formation 12. The shape of the probe, particularly at tapered portion 46, ensures a substantially hydraulic seal between the probe and formation 12 at wellbore wall 31 substantially independent of the extent of mudcake 30 lining wall 31, making an outside packer or sealing pad unnecessary. Thus, probe 16 is adapted for independently producing a seal at wall 31 of wellbore WB as the probe is moved to the extended position.

A port 48 is provided between leading portion 42 and tapered portion 46 in elongated cylindrical probe section 49. Port 48 may otherwise be located nearer tapered section 46 or upon nose portion 42, but the location shown in FIGS. 3A–3D is presently preferred. Passageway 50, including elongated section 50*a* and offset section 50*b*, extends from port 48 through tapered portion 46 to pressure junction 52 in trailing portion 44 for communicating the pressure of formation 12 from the port to the pressure junction. Passageway 50 further extends beyond pressure junction 52 through piston body 70 to back wall 60, for purposes that are described further below.

Probe 16 further includes, in trailing section 44, pressure sensor 54 communicating with passageway 50 of the probe via pressure junction 52 for measuring the pressure of the formation engaged by the probe. The pressure sensor may be disposed within the probe, as shown in FIGS. 3A–3D, but it can also be disposed elsewhere such as within drill collar 10 or actuating means 14,as indicated at 54' in FIG. 2. Preferably, pressure sensor 54 is of the sensor type described in U.S. patent application Ser. No. 09/019,466, assigned to the assignee of the present invention, the entire contents of which are incorporated herein by reference. Thus, sensor 54 has the capability of sensing and recording pressure data, and transmitting signals representative of such pressure data to receiver circuitry within data receiver 55 within drill collar 10 for further transmission through drill string DS in a manner that is known in the art, such as through mud pulse telemetry. While sensor 54 is described herein for use with pressure data only, the present invention further contemplates the use of sensors which are adaptable for sensing, recording, and transmitting data representative of other formation parameters, such as temperature and permeability. Such a sensor need only be placed in contact with the formation fluid at some point in the fluid flow passageway, in other words, at a measuring junction which permits the sensor to acquire the desired formation parameter data.

Those skilled in the art will further appreciate that sensor 54 could be hard-wired to data receiver 55, such as by extending wiring from the sensor through the piston ram or body which moves the probe, across the bore that the piston moves through, and through a sealed passageway in the body of drill collar 10 to receiver 55. Such wiring would be of a length to accommodate the movement of probe 16 and the piston along a direction transverse the drill collar.

The present invention contemplates the use of other fluid communicating means besides a passageway such as passageway 50. For example, the present invention contemplates the use of various hydraulic interface means such as a membrane or bladder positioned at an orifice in the probe surface and having a sensor such as a strain gauge or piezoelectric crystal attached thereto to indicate a property of the formation fluid such as pressure. Those of ordinary skill in the art will appreciate that such hydraulic interface means could also be combined with a passageway similar to passageway 50 for communicating properties such as formation fluid pressure.

As indicated above, FIGS. 3A–3D illustrate a second embodiment of actuating means 14 for moving the probe between the retracted and extended positions. Cylindrical piston body 70 is disposed in cylindrical bore 72, and is connected to probe 16 for forcibly moving the probe along the axis of bore 72 under hydraulic power. Preferably, piston 70 and probe 16 are manufactured as a substantially monolithic structure. In other words, to the extent possible, the piston and probe of one embodiment are made from a single piece of material.

Figure 3A:
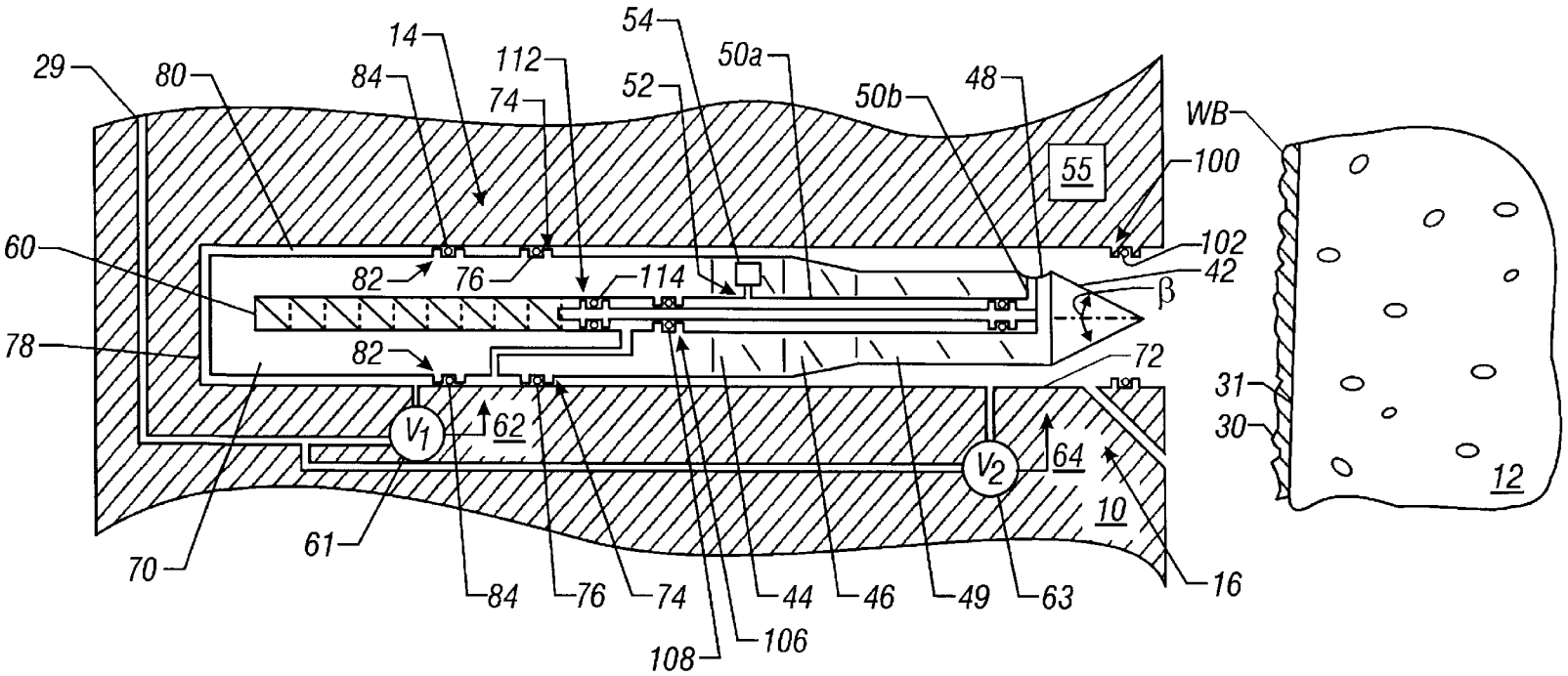

FIG. 3A shows the probe in the retracted position, which is the desired position for running drill collar 10 in and out of wellbore WB. In this position, drilling fluids in the wellbore are free to enter the forward portion of bore 72 and pressurize the bore, imparting a force against outwardly enlarged piston ring portion 74, which carries O-ring 76 to seal off the forward portion of the bore. The force against ring portion 74 keeps the probe-piston assembly deep inside bore 72 and butted up against back wall 78 of the bore. Otherwise, mechanical means such as releasable retainer holding piston 70 against back wall 78 could be employed for this purpose.

Figure 3B:
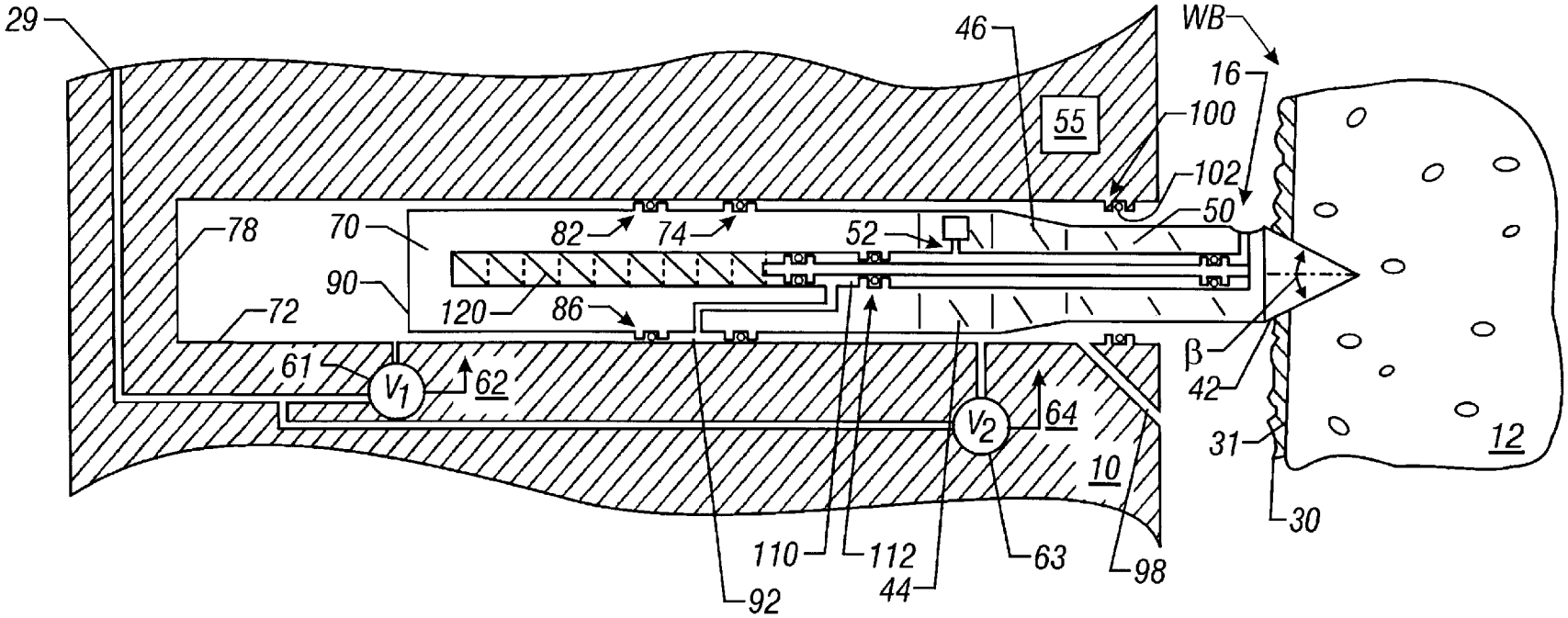

Piston 70 is hydraulically actuated by opening valve 61, which is normally closed, using signal conductor 62. The signal conductor communicates control signals from power cartridge 34 to open valve 61, pressurizing isolated bore region 80 with hydraulic fluid from hydraulic system 28 via passageway 29. Bore region 80 is isolated by outwardly enlarged piston ring portion 82 carrying O-ring 84. The pressure of the hydraulic fluid entering isolated region 80 imparts a lateral force on ring portion 82 which exceeds the lateral force applied to ring portion 74, nose portion 42, and tapered portion 46 from the wellbore fluid to move the piston-probe assembly towards formation 12 and into contact with mudcake 30 and wall 31 of wellbore WB, as shown in FIG. 3B.

As piston 70 moves across bore 72, isolated region 80 is opened as back wall 90 of the piston moves away from back wall 78 of bore 72. As the piston-probe assembly advances through bore 72, nose portion 42 engages mudcake 30, wellbore wall 31, and formation 12, sequentially. The nose portion is preferably conical and exhibits a relatively sharp angle $\beta$ of 45° or less, as described in greater detail below. This sharp angle facilitates entry of probe 16 into formation 12 under the hydraulic power provided via hydraulic system 28 and passageway 29 of actuating means 14.

As probe 16 is moved into the formation, wellbore fluid in the forward region of bore 72 is expelled by the advance of ring portion 74 and accompanying seal 76. Passageway 98 permits the continued expulsion of wellbore fluid from bore region 96, as seen in FIG. 3C, which is isolated after piston body 70 is moved into engagement with inwardly enlarged bore ring portion 100, which carries O-ring 102.

Figure 3C:
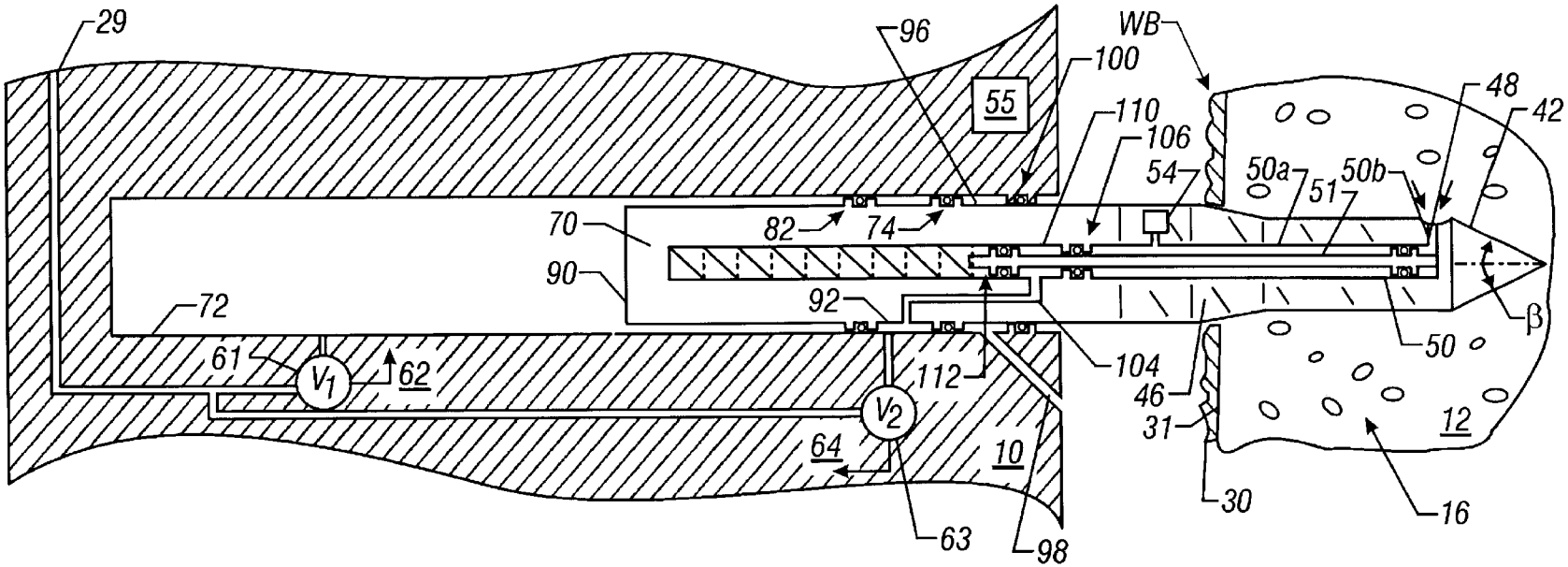

FIG. 3C thus illustrates the probe having been moved to its extended position wherein tapered portion 46 is hydraulically sealed at wellbore wall 31, restricting the invasion of wellbore fluids into the formation at the area of engagement. The seal is formed at the interaction of mudcake layer 30, wall 31, and formation 12 about the perimeter of tapered portion 46.

Figure 3D:
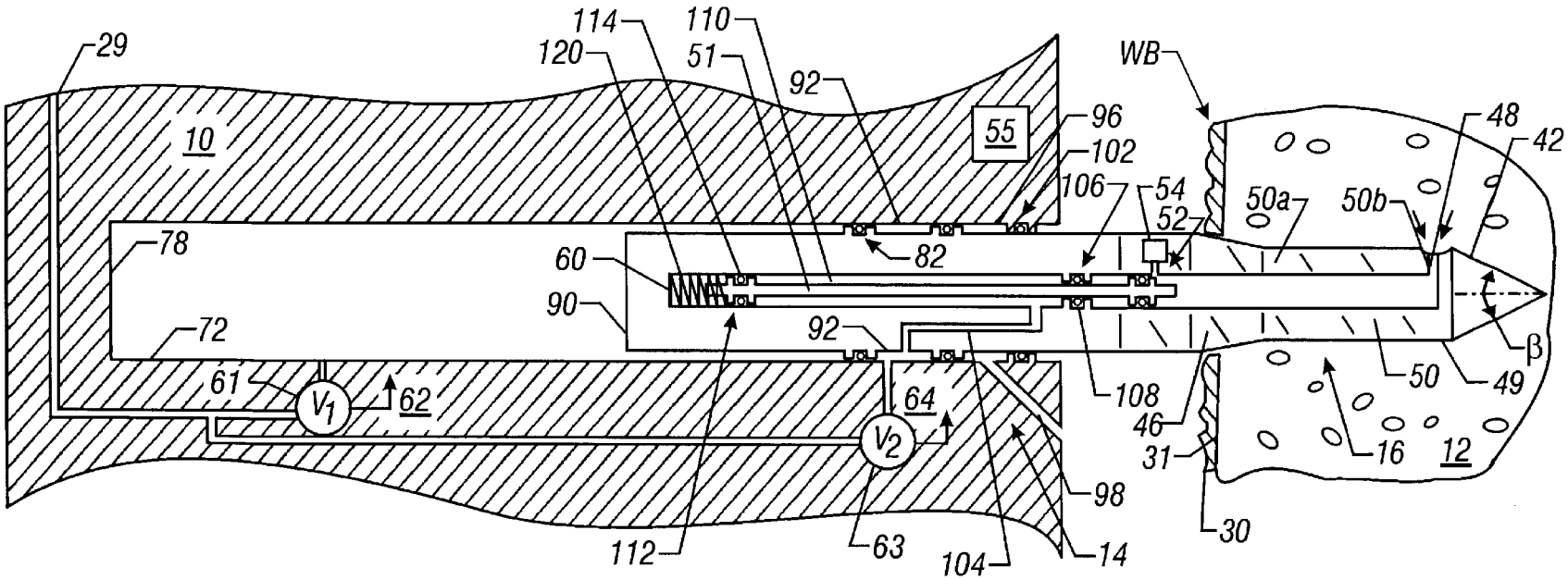

Once penetration of formation 12 is accomplished by positioning probe 16 in the extended position, the next step is to open passageway 50 inside the probe to allow formation fluids to enter the probe. With reference first to FIG. 3C, at the extended position of the probe, piston 70 has been moved substantially across bore 72 so that isolated region 92 formed between ring portions 82 and 74 is positioned for communication with passageway 94 connected to valve 63. Valve 63 is then opened to permit hydraulic fluid from passageway 29 to enter passageway 94, region 92, and passageway 104 and isolated area 110 formed between inwardly expanded piston ring portion 106 carrying O-ring 108 and outwardly expanded pin ring portion 112 carrying O-ring 114. The pressurization of isolated region 110 imparts a force against ring portion 112 which moves pin 51 towards the back wall 60 of piston passageway 50, as shown in FIG. 3D. As this occurs, formation fluid is drawn into probe passageway section 50*a* via port 48 and passageway offset 50*b*.

Pin 51 is normally urged towards the front of passageway 50 so as to contact passageway offset portion 50*b*, as seen in FIGS. 3A–3C, under the force of yieldable coil spring 120. The backward movement of pin 51 compresses spring 120, as seen in FIG. 3D, and opens pressure junction 52 to passageway 50 so that formation fluid filling passageway 50 communicates with pressure sensor 54. The actual amount of liquid being moved through passageway 50 during the pressure measuring process is very small. Hence the final shut-in pressure will be measured very quickly. As indicated previously, sensor 54 then communicates the pressure data to receiver 55 for further transmission to surface equipment.

Once the desired formation pressure data or other data has been collected, the pressure in hydraulic passageway 29 is reduced by opening a relief valve (not shown) in hydraulic system 28. Because valves 61 and 63 remain open, this reduces the pressure of the hydraulic fluid in the isolated portions of piston passageway section 50*a* and drill collar bore 72, resulting in two actions. First, as the pressure in the section of passageway 50 isolated by ring portions 112 and 106 is reduced, at some point the potential energy in spring 120 will exert a force on ring portion 112 that exceeds the force of the hydraulic fluid. When this occurs, spring 120 will expand under its own energy to return pin 51 to the position shown in FIG. 3C. This return action has the effect of expelling the formation fluid in passageway 50.

Second, as the pressure in the region of bore 72 between bore back wall 78 and piston back wall 90 and ring portion 82 is reduced, at some point the forward lateral force on piston 70 resulting from this pressure will drop below the backward lateral force exerted on the piston from well fluid present in isolated region 96. However, the force exerted by the well fluid upon piston portion 82 must also overcome the sticking force acting on probe 16, which results from the engagement of the probe with mudcake 30 and formation 12. Thus, the pressure at the rear portion of bore 72 must be substantially reduced for wellbore pressure to withdraw piston 16 from its extended position and return the piston to the retracted position of FIG. 3A. Those skilled in the art will recognize that the pressure applied to bore region 96 can be supplemented by providing an additional hydraulic flow passage to that region that is controlled by a valve to ensure that sufficient pressure is applied to piston 70 to free probe 16 from the formation.

FIGS. 4A–4E illustrate a second embodiment of the probe and actuating means of the present invention. Probe 216 of this embodiment includes first member 218 having first bore 220 therein. First probe member 218 is disposed for slidable movement within drill collar 10, as will be described further below. First bore 220 is substantially cylindrical but exhibits a variable diameter, being of larger diameter within trailing cylindrical section 219 of the first member and being of smaller diameter within tapered leading section 222 of the first member. The tapered outer surface of leading section 222 is adapted for substantially creating a seal at wellbore wall 31, and is thus functionally equivalent to tapered section 46 of probe 16.

Second probe member 224 is disposed for slidable movement within first bore 220 and includes second bore 226 therein. Second bore 226 is also substantially cylindrical and exhibits a variable diameter, being of larger diameter within trailing cylindrical section 228 of second probe member 224 and being of smaller diameter within leading cylindrical section 230 of the second probe member. Second probe member 224 is further equipped with conical nose portion 231, which is functionally equivalent to nose portion 42 of probe 16.

Third probe member 232 is disposed for slidable movement within second bore 226 and includes third bore 234 therein. Third bore 234 serves as a portion of a passageway for conducting fluid from the formation for measuring a property such as formation pressure, as will be described further below.

Actuating means 214, including sequence valves, and a series of flow lines and passages within drill collar 10 and probe 216 propel each of the first, second, and third probe members between extended and retracted positions according to a pre-defined sequence. FIG. 4B is a sectional view of drill collar 10 and probe 216 taken along section line 4B—4B in FIG. 4A. Probe 216 is thus shown in section from above as being disposed within bore 235 of drill collar 10. First probe member 218 is equipped with radially extending members 238*a* and 238*b* that are positioned for slidable movement within grooves 236*a* and 236*b* in bore 235. Radially extending members 238*a*, 238*b* thus constrain probe 216, particularly first probe member 218, to linear movement along the axis of bore 235 at a predetermined elevation relative to drill collar 10.

Members 238*a* and 238*b* are respectively connected to hydraulic rams 240*a* and 240*b*, which in turn are respectively connected to pistons 242*a* and 242*b*. Hydraulic fluid is directed from hydraulic system 28 via a single control valve (not shown) to parallel set lines 244*a*, 244*b*, pressurizing chambers 246*a*, 246*b* and thereby propelling pistons 242*a*, 242*b*, rams 240*a*, 240*b*, and members 238*a*, 238*b* forward. This action propels first probe member 218 towards formation 12.

Second probe member 224 is disposed within first bore 220, as mentioned above. At the interface of trailing section 228 and leading section 230, second probe member 224 forms a radially extending ring member 225, which sealingly engages first bore 220. Split ring or snap ring 240 is disposed in a groove near the trailing end 242 of first probe member 218. Spacing ring 244 is also positioned within bore 220 between snap ring 240 and ring member 225, and is sized with a diameter substantially equal to the diameter of ring member 225. Thus, the combination of snap ring 240 and spacing ring 244 induces second probe member 224 to move forward with first probe member 218 as chambers 246*a*, 246*b* are pressurized by hydraulic system 28.

As probe 216 is propelled forward by actuating means 214, nose portion 231 first engages the formation and bores through formation wall 31 under the force transmitted via snap ring 240. Shortly after nose 231 penetrates formation 12, leading tapered section 222 of first probe member 218 engages mud cake 30 and wellbore wall 31. The outer surface taper of leading section 222 expands from that section's leading edge towards the interface of the tapered surface with trailing section 219. This expansion has the effect of causing a substantial increase in the probe frontal surface area being propelled through formation 12 as tapered section 222 penetrates wellbore wall 31, and thereby increases the pressure in chambers 246*a*, 246*b* and set lines 244*a*, 244*b*. The control valve (not shown) controlling the hydraulic fluid delivered to parallel set lines 244*a*, 244*b* senses the pressure increase, and is designed to shut off the flow when the pressure reached a predetermined point. In this manner, first probe member 218 is propelled forward to the point that tapered section 222 is positioned in substantial engagement with wellbore wall 31, but not driven completely through the wellbore wall. FIG. 4C displays the engagement position of tapered section 222 with wellbore wall 31, whereby probe 216 forms a seal with the wellbore to prevent fluids from crossing the wellbore wall at the point of penetration.

The next step involves the propulsion of second probe member 224 from a retracted position relative to first probe member 218, as seen in FIG. 4C, to an extended position whereby nose portion 231 is substantially forward of tapered section 222, as seen in FIG. 4D. With reference to FIG. 4D, such propulsion is accomplished by pressurizing set line 248 with hydraulic fluid from hydraulic system 28. The hydraulic fluid is delivered through set line 248 to chamber 250, pressurizing chamber 250.

Spacing ring 244 is equipped with O-rings so as to place spacing ring 244 in sealed engagement with trailing section 219 of the first probe member and the outer cylindrical surface of trailing section 228 of the second probe member. Ring member 225 also includes an O-ring for sealed engagement with trailing section 219. As a result, chamber 250 is sealed, and the pressurized hydraulic fluid in the chamber imparts a forward propulsion force on ring member 225 which urges second probe member 224 forward through first probe member 218 into formation 12.

The next step in the sequential operation of probe 216 involves the retraction of third probe member 232. With reference again to FIG. 4D, once second probe member 224 reaches the extent of its forward travel as defined by bore 220, the hydraulic fluid pressure in chamber 250 rises. At a predetermined point, the pressure in chamber 250 will reach a sufficient level for a sequencing valve (not shown) connected to flow line 248 to open a flow path to passage 252, delivering the hydraulic fluid to chamber 254 (see FIG. 4E) and imparting a rearward force to third probe member 232 to urge that member backwards within second bore 226. As third probe member 232 is propelled from the extended position of FIG. 4D to the retracted position of FIG. 4E, tubular extension 256 of second probe member 224 is fully engaged by bore 234. When this occurs, fluid from formation 12 is drawn through port 257 into fluid passageway 258 that is formed by bore 260. The formation fluid then flows sequentially through filtering screen 261 into annulus 262, circular passage 264, bore 266, bore 234, bore 268, chamber 270, and flow line 271. Pressure sensor 274 is connected to flow line 271 at measuring junction 272 for reading and transmitting data to the surface indicative of the formation fluid pressure.

Once the appropriate pressure or other data reading has taken place, the sequence of operating probe 216 is reversed to place the probe in its retracted position within the wellbore and drill collar 10. Referring again to FIG. 4E, retract line 276 is pressurized with hydraulic fluid from hydraulic system 28 to pressurize annular chamber 278 behind third probe member 232. The pressure in chamber 278 imparts a force against radially enlarged rear section 233 of third probe member 232 which urges member 232 forward into bore 260. Such forward action of the third probe member has the effect of expelling the formation fluid in bore 260 back through port 257.

Once member 232 has been returned to its forward position, shown in FIG. 4D, it is restricted from further forward movement and the fluid pressure in chamber 278 begins to rise. Chamber 278 is fluidly connected to passages 280 and 282 in second probe member 224. When the pressure in chamber 278 reaches a predetermined level, sequence valve 215 opens, permitting fluid flow from chamber 278 through passages 280, 282 into chamber 284, and then to passages 286, 288, and finally into annular chamber 290, as shown in FIG. 4D. The fluid pressure in chamber 290 imparts a force against second probe member 224 which urges member 224 backwards within first bore 220 to the retracted position of FIG. 4C. When the second probe member reaches the retracted position, it abuts spacing ring 244 and the fluid pressure in chamber 290 rises. When a predetermined pressure level is reached, sequence valve 215 closes the hydraulic fluid flow through passage 282, sealing off chamber 290 whereby second probe member 224 is pressure locked in the retracted position.

The next step in the retraction sequence is the retraction of first probe member 218. For this purpose, parallel retract lines 292*a* and 292*b* are pressurized with hydraulic fluid from hydraulic system 28. This action pressurizes chambers 294*a*, 294*b* and imparts forces which urge pistons 242*a*, 242*b* backwards and draw first probe member 218 to the retracted position of FIGS. 4A and 4B, at which time drilling operations may be resumed.

FIGS. 5A–5C illustrate a third embodiment of the probe and actuating means of the present invention. Probe 316 of this embodiment includes first member 318 having first bore 320 therein. First probe member 318 is disposed for slidable movement within drill collar 10, as will be described further below. First bore 320 is substantially cylindrical but exhibits a variable diameter, being of larger diameter within trailing cylindrical section 319 and longitudinal central section 321 of the first probe member, and being of smaller diameter within tapered leading section 322 of the first probe member. As described in the above mentioned embodiments, the tapered outer surface of leading section 322 is adapted for substantially creating a seal at wellbore wall 31, and is thus functionally equivalent to tapered section 46 of probe 16 and tapered section 222 of probe 216.

Second probe member 324 is disposed for slidable movement within first bore 320 and includes second bore 326 therein. Unlike first bore 320, second bore 326 is cylindrical and exhibits a constant diameter. Second member 324 is further equipped with conical nose portion 331, which is functionally equivalent to nose portion 42 of probe 16 and nose portion 231 of probe 216.

Third probe member 332 is disposed for slidable movement within second bore 326 and includes third bore 334 therein. Third bore 334 serves as a portion of a passageway for conducting fluid from the formation for measuring a property such as formation pressure, as will be described further below.

Actuating means 314, including sequence valves, and a series of flow lines and passages within drill collar 10 and probe 316 propel each of the first, second, and third probe members between extended and retracted positions according to a pre-defined sequence. First probe member 318 is equipped with radially enlarged trailing section 319 that is positioned for sealed slidable movement along bore 336 in drill collar 10. Section 319 thus constrains probe 316, particularly first probe member 318, to linear movement along the axis of bore 336. Second probe member 324 is disposed within first bore 320, as mentioned above. More particularly, trailing section 328 forms a radially extending annular or ring member which sealingly engages first bore 320. The first step in actuating probe 316 involves the propulsion of second probe member 324 from the retracted position seen in FIG. 5A to an extended position, as seen in FIG. 5B. Such propulsion is accomplished by pressurizing set line 344 with hydraulic fluid from hydraulic system 28. The hydraulic fluid is delivered through set line 344 to chamber 350 formed in drill collar 10, pressurizing the chamber. Ring member 328 includes an O-ring for sealed engagement with first bore 320. As a result, the pressurized hydraulic fluid in the chamber imparts a forward propulsion force on ring member 328 which urges second probe member 324 forward through first probe member 318 into formation 12.

Bore 320 is reduced at shoulder 323 to a smaller diameter near the interface of leading tapered section 322 and central section 321. At some point during the forward propulsion of second probe member 324 by actuating means 314, ring member 328 is moved into engagement with shoulder 323. When this occurs, first probe member 318 is also propelled forward by the pressure in chamber 350, which continues to expand. First probe member 318 will also be urged forward by fluid in chamber 350 entering the unsealed space between the back wall of trailing section 319 and drill collar 10.

Nose portion 331 first engages formation 12 and bores through formation wall 31 under the force transmitted via actuating means 314. Substantially after nose 331 penetrates formation 12, leading tapered section 322 of first probe member 318 engages mud cake 30 and wellbore wall 31, as shown in FIG. 5B.

The outer surface taper of leading section 322 expands from its leading edge towards the interface of the tapered surface with central section 319. This expansion has the effect of causing a substantial increase in the probe frontal surface area being propelled through formation 12 as section 322 penetrates wellbore wall 31, and thereby increases the pressure in chamber 350 and set line 344. A control valve (not shown) controlling the hydraulic fluid delivered to set line 344 senses the pressure increase, and is designed to shut off the flow when the pressure reached a predetermined point. In this manner, first probe member 318 is propelled forward to the point that tapered section 322 is positioned in substantial engagement with wellbore wall 31, but not driven completely through the wellbore wall. FIG. 5B displays the engagement position of tapered section 322 with wellbore wall 31, whereby probe 316 forms a seal with the wellbore to prevent fluids from crossing the wellbore wall at the point of penetration.

The next step in the sequential operation of probe 316 involves the retraction of third probe member 332. For this purpose, flexible conduit 300, a section of which is shown in detail in FIG. 5D, extends from the back wall of chamber 350 to connector 301, which connects the conduit to the rear of second probe member 324. Conduit 300 conducts hydraulic fluid via flow line 302 to pressurize chamber 354. The pressure in chamber 354 imparts a rearward force to third probe member 332 to urge that member backwards within second bore 326. As third probe member 232 is propelled from the extended position of FIG. 5B to the retracted position of FIG. 5C, tubular extension 356 of second probe member 324 is fully engaged by bore 334. When this occurs, fluid from formation 12 is drawn through port 357 into the fluid passageway that is formed by lateral passage 360, bore 362, chamber 364, bypass passage 366, bore 334, bore 368, and flow line 304. Flow line 304 is also conducted by flexible conduit 300 as shown in FIG. 5D. Referring back to FIG. 5C, pressure sensor 374 is connected to flow line 304 at measuring junction 372 for reading and transmitting data to the surface indicative of the formation fluid pressure.

Once the appropriate pressure or other data reading has taken place, the sequence of operating probe 316 is reversed to place the probe in its retracted position within the wellbore and drill collar 10. Retract line 305, also within conduit 300 (see FIG. 5D), is pressurized with hydraulic fluid from hydraulic system 28 to pressurize annular chamber 378 behind third probe member 332. The pressure in chamber 378 imparts a force against radially enlarged rear section 333 of member 332 which urges member 332 forward towards bore 362. Such forward action of the third probe member has the effect of expelling the formation fluid in chamber 364 back through port 357.

Once member 332 has been returned to its forward position, shown in FIG. 5B, the next step is to retract first probe member 318 from its extended position. For this purpose, retract line 392 is pressurized with hydraulic fluid from hydraulic system 28. This action pressurizes chamber 394 and imparts a force which urges first probe member 318 backwards and returns the first probe member to its retracted position. As this occurs, shoulder 323 of the first probe member applies a force against ring member 328 which pulls second probe member 324 at least partially free of formation 12.

The final step in the retraction sequence is the retraction of second probe member 324 from its extended position relative to the first probe member. For this purpose, hydraulic fluid is supplied from hydraulic system 28 through flow line 306 to pressurize chamber 390. The fluid pressure in chamber 390 imparts a force against second probe member 324 which urges member 324 backwards within first bore 320 to the retracted position of FIG. 5A. At this point, the probe is fully within drill collar 10, and drilling operations may be resumed.

Analysis of the Probe Nose

As indicated previously, the nose portion of probe 16 is preferably shaped for reducing the force required from the actuating means for moving the probe to the extended position. More particularly, the nose may be conical with a cone inclination angle β no greater than 45°. For a probe having a nose cone inclination angle β less than 45°, which is considered a "sharp" nose, the velocity field around the tip of the nose portion will be cylindrically radial. The penetration pressure for a sharp nosed probe, $p_p^{sharp}$, is described as:

$$p_p^{sharp} = \frac{p_c}{\cos\beta\tan(\beta-\psi)},$$

where $p_c$=cylindrical cavitation pressure,

β=cone inclination angle (see FIG. 3A), and

ψ=interface friction angle.

Cavitation pressure is used here to mean the pressure at which unbounded growth of a cavity created by a penetrating probe with a conical head takes place. The cavitation pressure is characterized as spherical cavitation pressure for blunt tools (β>45°) and cylindrical cavitation pressure for sharp tools (β<45°). Since the penetration pressure is proportional to the cavitation pressure, pressure scaling (effect of pressure ratios) can be taken into account. The penetration pressure can therefore also be defined as:

$$p_p^{sharp} = q\Pi_p,$$

where q=unconfined stress (lbf/in$^2$ or N/mm$^2$) which accounts for the strengthening effect of the in-situ stress, and $\pi_p$=dimensionless penetration pressure.

It follows that the penetration force (lbf or N) can be written as:

$$F_p = \pi a_0^2 q\Pi_p,$$

where $a_0$=nominal radius (inches or millimeters) of the penetrating object (probe 16, 216, 316). The dimensionless penetration pressure, $\pi_p$, is a function of several rock formation properties, including Young's Elastic Modulus, Poisson's Ratio, uniaxial compressive strength, internal friction angle, and dilatency angle.

FIG. 4 is an idealized plot for a frictionless material showing the evolution of the force $F_p$ that needs to be applied to cause penetration of a cylindrical object with the penetration depth d. Those skilled in the art will appreciate that the probe is assumed to be substantially cylindrical for purposes of this discussion, but the present invention is not so limited. The force $F_p$ is scaled by the cross-sectional area of the cylindrical probe times the uniaxial compressive strength (along the axis of penetration) of the penetrated rock formation, and the penetration depth d is scaled by the radius $a_0$ of the probe. The force-depth penetration relationships are calculated for a typical reservoir rock in the absence of an in-situ stress. The upper and lower bounds plotted in FIG. 4 correspond to two extreme values of a parameter characterizing the inelastic volume change of the rock. The variation of the penetration force over the range of penetration depth labeled as 'transition' does not rely on any models, but represents an estimate of the force-depth penetration relationship between a range of penetration depth where only the nose portion of the probe is penetrating the formation (force $F_p$ increases rapidly with depth d) and a range of penetration depth where the nose portion is entirely within the formation (force F is substantially constant).

An analysis of penetration pressures for various nose cone inclination angles and typical rock property values indicates that dimensionless penetration pressure for blunt tools is greater than for sharp ones for realistic values of the interface friction angle (ψ<30°). In actual terms, the maximum penetration resistance (pressure) which must be overcome by a blunt probe that penetrates a downhole confined formation, in other words, a highly compressed formation such as that encountered thousands of feet below the surface in present day oil wells, can be as high as 20 times the compressive strength of an unconfined formation. Forces on a sharp tool, for example a probe having a conical nose with an angle of 45° or less, during quasi-static penetration are considerably smaller.

Those skilled in the art and given the benefit of this disclosure will appreciate that by utilizing a drilling tool with a penetrating probe, as described herein, pressure measurements while drilling can be obtained in a straightforward, fast, and reliable manner. The reliability of the probe is enhanced by the fact that, in its retracted position, the probe is inside a cavity of the drill collar (or other deployment tool such as a wireline sonde) and protected from the drilling environment. Furthermore, the probe of the present invention may be used repeatedly during a single trip to sense formation pressure or other parameters at several wellbore depths.

In view of the foregoing it is evident that the present invention is well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. For example, a hydraulic connection can be provided to the probe passageway that allows formation fluid samples to be taken. Also, the probe could be embodied in various other configurations that provide the advantages of the present invention.

The present embodiment is, therefore, to be considered as merely illustrative and not restrictive. The scope of the invention is indicated by the claims that follow rather than the foregoing description, and all changes which come within the meaning and range of equivalence of the claims are therefore intended to be embraced therein.

What is claimed is:

1. An apparatus for measuring a property of a subsurface formation intersected by a wellbore, comprising:

a tool body adapted for axial movement through the wellbore;

an actuating means carried by said tool body;

a probe propelled by said actuating means for substantially lateral or transverse movement of said probe between a retracted position within the wellbore and an extended position penetrating a wall of the wellbore such that said probe engages the formation, said probe including a tapered nose portion, a substantially cylindrical portion connected to the tapered nose portion, and a second tapered portion connected to the cylindrical portion, whereby said probe is adapted for substantially producing a seal at the wall of the wellbore as said probe is moved to the extended position and said probe having means therein for measuring the property of the formation at or near an area engaged by said probe.

2. The apparatus of claim 1, wherein the measuring means includes a passageway that extends from a port adjacent the tapered nose portion of said probe to a measuring junction within one of said probe, said actuating means, and said tool body so as to transmit fluid from the formation to the measuring junction.

3. The apparatus of claim 2, further comprising a sensor communicating with the passageway of said probe via the measuring junction to measure the property of the formation.

4. The apparatus of claim 3, wherein the sensor is a pressure sensor communicating with the passageway of said probe via the measuring junction to measure the pressure of fluid within the formation.

5. The apparatus of claim 1, wherein said tool body is a drill collar positioned within a drill string.

6. The apparatus of claim 1, wherein said tool body is a wireline sonde suspended in the wellbore.

7. The apparatus of claim 1, wherein said actuating means comprises a hydraulic piston actuated by hydraulic fluid to move said probe between the retracted and extended positions.

8. The apparatus of claim 7, wherein said probe and the hydraulic piston constitute a monolithic structure.

9. The apparatus of claim 2, wherein the nose portion is shaped for reducing the propulsion force required from said actuating means for moving said probe to the extended position.

10. The apparatus of claim 9, wherein the nose portion is conical.

11. The apparatus of claim 10, wherein the nose portion has a cone inclination angle no greater than 45°.

12. The apparatus of claim 3, wherein the sensor is disposed within said probe.

13. The apparatus of claim 3, wherein the sensor is disposed within said actuating means.

14. The apparatus of claim 3, wherein the sensor is disposed within said tool body.

15. The apparatus of claim 1, wherein the second tapered portion is adapted for substantially producing the seal at the wellbore wall as said probe is moved from the retracted position to the extended position.

16. The apparatus of claim 1, wherein said probe comprises a plurality of members.

17. The apparatus of claim 16, wherein the measuring means includes a passageway, and said probe comprises:

a first member having a first bore therein, a tapered outer surface formed at the second tapered portion, and propelled by said actuating means for movement of the first member between a retracted first member position within the wellbore and an extended first member position whereat the tapered outer surface at least partially penetrates the wall of the wellbore;

a second member disposed in the first bore and having a second bore therein, the tapered nose portion, a port communicating with the second bore, and propelled by said actuating means for movement of the second member through the first bore between a retracted second member position within the wellbore and an extended second member position whereat the tapered nose portion penetrates the formation and the port is positioned beyond the first member; and a third member disposed in the second bore, having at least a portion of the passageway therein, and propelled by said actuating means for movement of the third member through the second bore between a position closing the passageway and a position opening the passageway to permit formation fluid to enter the passageway via the port for measuring the property of the formation.

18. The apparatus of claim 17, wherein the nose portion is conically shaped.

19. An apparatus for measuring a property of a subsurface formation intersected by a wellbore, comprising:

a tool body adapted for axial movement through the wellbore;

an actuating means carried by said tool body;

a probe propelled by said actuating means for substantially lateral or transverse movement of said probe between a retracted position within the wellbore and an extended position penetrating a wall of the wellbore in engagement with the formation, said probe including a tapered nose portion, a substantially cylindrical portion connected to the tapered nose portion, a second tapered portion connected to the cylindrical portion for substantially forming a seal at the wall of the wellbore as said probe is moved to the extended position, and a passageway therein for measuring the property of the formation.

20. The apparatus of claim 19, wherein said probe further includes:

a trailing portion, and wherein the second tapered portion is disposed between the tapered nose and trailing portions when said probe is moved to the extended position, and the passageway extends through the second tapered portion when said probe is moved to the extended position.

21. The apparatus of claim 20, wherein the passageway extends from a port ahead of the second tapered portion of said probe to a measuring junction behind the second tapered portion of said probe when said probe is moved to the extended position so as to transmit fluid from the formation to the measuring junction.

22. The apparatus of claim 21, further comprising a sensor communicating with the passageway of said probe via the measuring junction to measure the property of the formation.

23. The apparatus of claim 22, wherein the sensor is a pressure sensor communicating with the passageway of said probe via the measuring junction to measure the pressure of formation fluid.

24. The apparatus of claim 19, wherein said tool body is a drill collar positioned within a drill string.

25. The apparatus of claim 19, wherein said tool body is a wireline sonde suspended in the wellbore.

26. The apparatus of claim 19, wherein said actuating means comprises a hydraulic piston actuated by hydraulic fluid to move said probe between the retracted and extended positions.

27. The apparatus of claim 26, wherein said probe and the hydraulic piston constitute a monolithic structure.

28. The apparatus of claim 20, wherein the tapered nose portion of said probe is shaped for reducing the propulsion force required from said actuating means for said probe to penetrate the wall of the wellbore and engage the formation.

29. The apparatus of claim 28, wherein the tapered nose portion is conical.

30. The apparatus of claim 29, wherein the tapered nose portion has a cone inclination angle no greater than 45°.

31. The apparatus of claim 22, wherein said sensor is disposed within said probe.

32. The apparatus of claim 22, wherein the sensor is disposed within said actuating means.

33. The apparatus of claim 22, wherein the sensor is disposed within said tool body.

34. The apparatus of claim 19, wherein said probe comprises:

a first member having the second tapered portion and a first bore therein and propelled by said actuating means for movement of the first member between a retracted first member position within the wellbore and an extended first member position whereat the second tapered portion at least partially penetrates and substantially forms a seal at the wall of the wellbore;

a second member disposed in the first bore and having a second bore therein, the tapered nose portion, a port communicating with the second bore, and propelled by said actuating means for movement of the second member through the first bore between a retracted second member position within the wellbore and an extended second member position whereat the tapered nose portion penetrates the formation and the port is positioned beyond the first member; and a third member disposed in the second bore and having the passageway therein and propelled by said actuating means for movement of the third member through the second bore between a position closing the passageway and a position opening the passageway to permit formation fluid to enter the passageway via the port for measuring the property of the formation.

35. A probe for measuring a property of a subsurface formation, comprising:

a body adapted for substantially lateral or transverse movement between a retracted position on a wellbore tool disposed in a wellbore intersecting the formation and an extended position penetrating a wall of the wellbore in engagement with the formation, said body having a tapered nose portion, a substantially cylindrical portion connected to the tapered nose portion, a second tapered portion connected to the cylindrical portion for substantially forming a seal at the wall of the wellbore when said probe is moved to the extended position, and means therein for communicating formation fluid from the formation to a measuring junction when said probe is moved to the extended position.

36. The probe of claim 35, wherein said body comprises a plurality of members.

37. The apparatus of claim 36, wherein the fluid communicating means includes a passageway, and said probe body comprises:

a first member having the second tapered portion and a first bore therein and propelled by said actuating means for movement of the first member between a retracted first member position within the wellbore and an extended first member position whereat the second tapered portion at least partially penetrates and substantially forms a seal at the wall of the wellbore;

a second member disposed in the first bore and having a second bore therein, the tapered nose portion, a port communicating with the second bore, and propelled by said actuating means for movement of the second member through the first bore between a retracted second member position within the wellbore and an extended second member position whereat the tapered nose portion penetrates the formation and the port is positioned beyond the first member; and a third member disposed in the second bore and having the passageway therein and propelled by said actuating means for movement of the third member through the second bore between a position closing the passageway and a position opening the passageway to permit formation fluid to reach the passageway via the port for measuring the property of the formation.

38. The probe of claim 37, wherein the nose portion is conically shaped.

39. A probe for measuring the pressure of a subsurface formation, comprising:

a body adapted for substantially lateral or transverse movement between a retracted position on a wellbore tool disposed in a wellbore intersecting the formation and an extended position penetrating a wall of the wellbore in engagement with the formation, said body having a tapered nose portion, a substantially cylindrical portion connected to the tapered nose portion, and a second tapered section connected to the cylindrical section for substantially producing a seal at the wall of the wellbore as said body is moved to the extended position and said body having means therein for communicating the pressure of formation fluid to a pressure measuring junction when said probe is moved to the extended position.

40. A method for measuring a property of a subsurface formation intersected by a wellbore, comprising the steps of:

moving a tool body through the wellbore to the depth of a desired formation, the tool body carrying a probe including a tapered nose portion, a substantially cylindrical portion connected to the tapered nose portion, and a second tapered portion connected to the cylindrical portion, and fluid communicating means in the probe;

moving the probe from a retracted position within the wellbore to an extended position penetrating a wall of the wellbore in engagement with the formation such that the second tapered portion of the probe substantially forms a seal at the wall of the wellbore; and communicating fluid from the formation through the fluid communicating means in the probe to a sensor to measure the formation property.

41. The method of claim 40, wherein the fluid communicating means includes a passageway, and the probe further includes:

a trailing portion, and wherein the second tapered portion is disposed between the tapered nose and trailing portions when the probe is moved to the extended position, and the passageway in the probe extends through the second tapered portion when the probe is moved to the extended position.

42. The method of claim 41, wherein the passageway in the probe extends from a port ahead of the second tapered portion of the probe to a measuring junction behind the second tapered portion of the probe when said probe is moved to the extended position.

43. The method of claim 42, wherein the sensor communicates with the passageway of the probe via the measuring junction to measure the property of the formation.

44. The method of claim 43, wherein the sensor is a pressure sensor communicating with the passageway of the probe via the measuring junction to measure the pressure of the formation fluid.

45. The method of claim 40, wherein the tool body is a drill collar positioned within a drill string.

46. The method of claim 40, wherein the tool body is a wireline sonde suspended in the wellbore.

47. The method of claim 40, wherein the probe is moved between the retracted and extended positions by a hydraulic piston carried by the tool body and actuated by hydraulic fluid within the tool body.

48. The method of claim 47, wherein the probe and the hydraulic piston constitute a monolithic structure.

49. The method of claim 47, wherein the tapered nose portion of the probe is shaped for reducing the force required from the hydraulic piston for the probe to penetrate the wall of the wellbore and engage the formation.

50. The method of claim 40, wherein the sensor is disposed within the probe.

51. The method of claim 40, wherein the sensor is disposed within a hydraulic piston assembly carried by the tool body and actuated by hydraulic fluid within the tool body for moving the probe between the retracted and extended positions.

52. The method of claim 40, wherein the step of moving the probe from the retracted position to the extended position includes the steps of:

moving a first probe member having the second tapered portion and a first bore therein from a retracted first probe member position within the wellbore to an extended first probe member position whereat the second tapered portion at least partially penetrates and substantially forms a seal at the wall of the wellbore; and moving a second probe member having a second bore therein, the tapered nose portion, and a port communicating with the second bore through the first bore from a retracted second probe member position within the wellbore to an extended second probe member position whereat the tapered nose portion penetrates the formation and the port is positioned beyond the first member.

53. The method of claim 52, wherein the fluid communicating means of the probe includes a passageway, and further comprising the step of moving a third probe member having the passageway therein through the second-bore from a position closing the passageway to a position opening the passageway to permit formation fluid to reach the passageway via the port for measuring the property of the formation.

54. The method of claim 52, wherein the tapered nose portion of the second probe member is conically shaped.

* * * * *